US007926388B2

(12) United States Patent
Lu

(10) Patent No.: US 7,926,388 B2
(45) Date of Patent: Apr. 19, 2011

(54) HAND TOOL

(75) Inventor: Yu-Han Lu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 184 days.

(21) Appl. No.: 12/240,407

(22) Filed: Sep. 29, 2008

(65) Prior Publication Data

US 2009/0178516 A1 Jul. 16, 2009

(30) Foreign Application Priority Data

Jan. 15, 2008 (CN) ..... 2008 1 0300101

(51) Int. Cl.
*B25B 13/48* (2006.01)
*B25B 17/00* (2006.01)

(52) U.S. Cl. ..... 81/57.36; 81/57.32

(58) Field of Classification Search ..... 81/57.36, 81/57.22, 57.24, 57.32, 467, 473–477
See application file for complete search history.

(56) References Cited

U.S. PATENT DOCUMENTS

| | | | | |
|---|---|---|---|---|
| 710,676 | A * | 10/1902 | Finn | 81/57.36 |
| 1,141,864 | A * | 6/1915 | Boucher | 81/57.36 |
| 5,074,170 | A * | 12/1991 | Shirley | 81/57.3 |
| 5,277,085 | A * | 1/1994 | Tanimura et al. | 81/57.22 |
| 6,668,685 | B2 * | 12/2003 | Boston | 81/57.22 |
| 2006/0169107 | A1 * | 8/2006 | Taniguchi et al. | 81/57.22 |

FOREIGN PATENT DOCUMENTS

JP 58196943 A * 11/1983

* cited by examiner

*Primary Examiner* — Hadi Shakeri
(74) *Attorney, Agent, or Firm* — Andrew C. Cheng

(57) ABSTRACT

A hand tool comprises a support, a handle, at least two spindles, a driver, at least two followers and at least two spanners. The handle is rotatably mounted on a middle portion of the support. The at least two spindles are respectively fixed to two opposite ends of the support by ends thereof. The driver is mounted on an end of the handle. The at least two followers are respectively rotatably attached on another end of each spindle and drivably connected with driver. The at least two spanners are attached on a surface of each follower which is away from the corresponding spindle.

1 Claim, 4 Drawing Sheets

HAND TOOL

BACKGROUND

1. Technical Field

The present invention relates to a hand tool and more particularly, to a hand tool capable of driving more than one fastener simultaneously and tightening the fasteners to equal a calculated torque.

2. Description of the Related Art

In the process of assembling two or more workpieces together or locating workpieces on a worktable, a number of fasteners such as cap screws or studs are usually adopted to connect or fasten those workpieces. Referring to FIG. 4, a first workpiece 310 and a second workpiece 320 are joined by a bolted joint 330, and two spring pads 340 are respectively disposed between the first and second workpieces 310 and 320. Each bolted joint 330 includes a cap screw 332 that captures and joins the fist workpiece 310, the spring pad 340 and the second workpiece 320, and a nut 334 for securing the cap screw 332. The cap screws 332 are symmetrically located on the first and second workpieces 310, 320. When a cap screw 310 is tightened, the spring pad 340 between the first and second workpiece 310, 320 is compressed, while a preload or a torque applied on each cap screw 310 should be controlled accurately to control compressed length of the spring pad 340 in a receivable range so that the first workpiece 310 and the second workpiece 320 can be parallel with each other and be fixed stably evenly, and accurately. However, it is difficult to control the preload or torque applied on each cap screw to get equal compression on the each spring pad because the cap screws installed one by one by possibly more than one operator. Therefore, the second workpiece may not be properly aligned with the first workpiece.

Therefore, it is desired to design a hand tool capable of driving more than one fastener simultaneously and tightening the fasteners to equal a calculated torque.

SUMMARY

An exemplary hand tool comprises a support, a handle, at least two spindles, a driver, at least two follower and at least two spanners. The handle is rotatably mounted on a middle portion of the support. The at least two spindles are respectively fixed to two opposite ends of the support by ends thereof. The driver is mounted on an end of the handle. The at least two followers are respectively rotatably attached on another end of each spindle and drivably connected to the driver. The at least two spanners are attached on a surface of each follower which is away from the corresponding spindle.

Those and other advantages and novel features will be more readily apparent from the following detailed description set forth below taken in conjunction with the accompanying drawings.

DETAILED DESCRIPTION OF THE PREFERRED EMBODIMENTS

Figure 1:
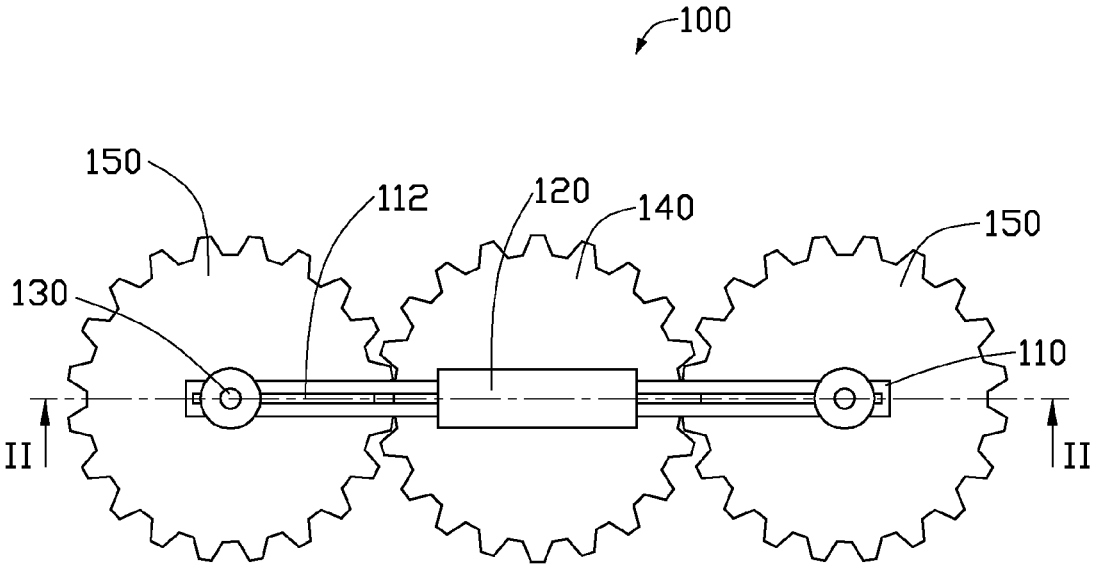
FIG. 1 is a schematic top view of an hand tool according to a first exemplary embodiment.
Figure 2:
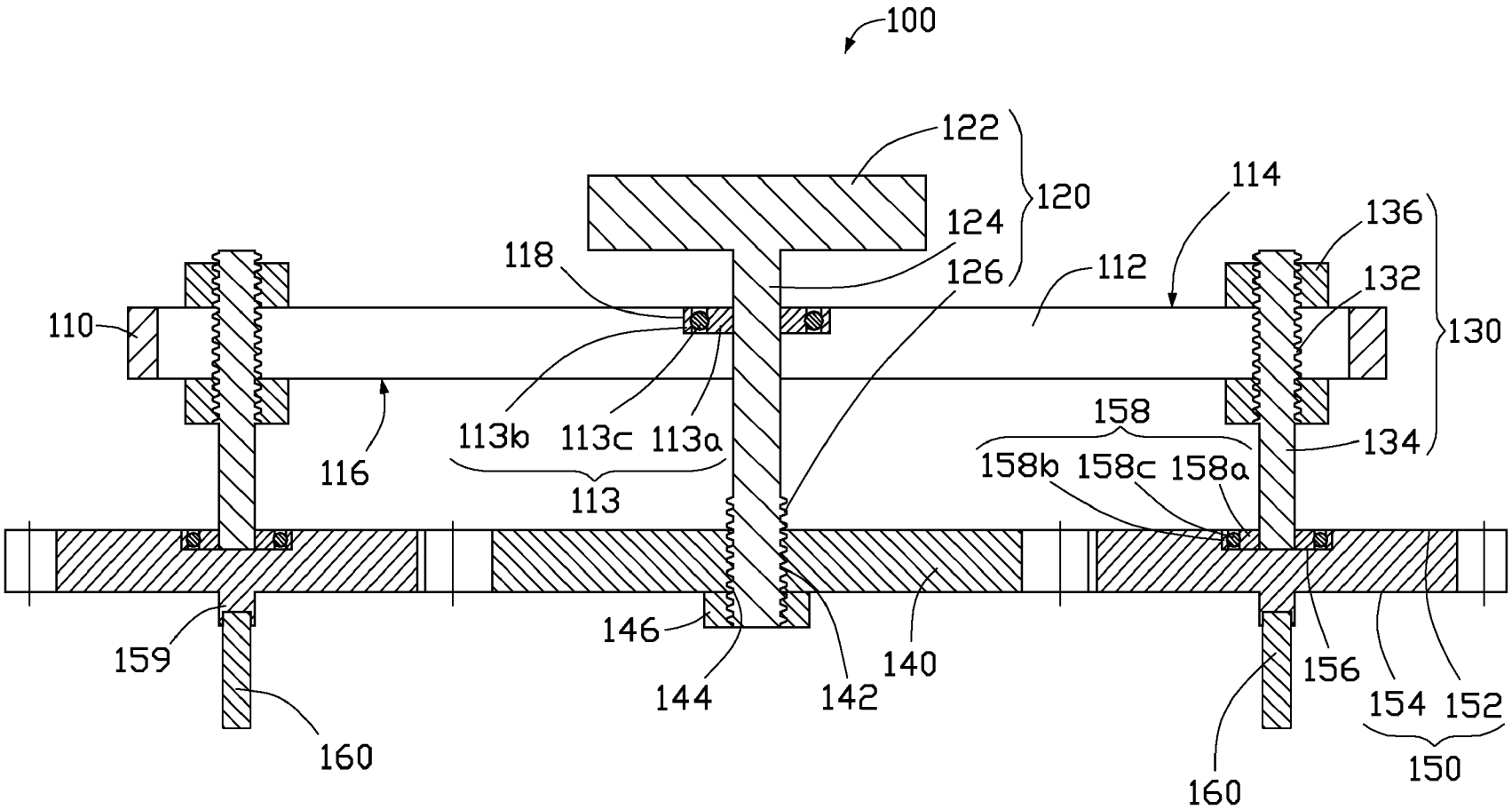
FIG. 2 is cross-sectional view of the hand tool in FIG. 1 taken along line II-II.

Referring FIGS. 1 and 2, a hand tool 100 according to a first exemplary embodiment includes a support 110; a handle 120, at least two spindles 130, a driver 140, at least two followers 150 and at least two spanners 160. The handle 120 is rotatably mounted on a middle portion of the support 110. The at least two spindles 130 are respectively fixed to two opposite ends of the support 110. The driver 140 is mounted on an end of the handle 120. The at least two followers 150 are respectively rotatably attached on an end of each spindle 130 and meshed or drivably connected to the driver 140. The at least two spanners 160 are respectively attached on a surface of each follower 150 far away from the corresponding spindle 130.

The support 110 defines at least one channel 112 thereon which runs through the support 110 from an upper surface 114 to a lower surface 116. A first bearing hole 118 is formed on the middle portion of the upper surface 114 for receiving a first bearing 113. The first bearing 113 includes a first inner ring 113*a*, a first outer ring 113*b* and a number of first balls 113*c* contained between the first inner ring 113*a* and the first outer ring 113*b*. The first outer ring 113*b* is fixed to the inner wall of the first bearing hole 118 of the support 110.

The handle 120 includes a haft 122 and a shaft 124 connected on the middle portion of the haft 122 by one end thereof. The handle 120 is designed for driving the driver 140 to rotate by manual manner. Another end of the shaft 124 defines a connecting structure 126 thereon such as screw thread, splines, keyways and so on for connecting the driver 140. The shaft 124 of the handle 120 passes through the first inner ring 113*a* of the first bearing 113 and is fixed thereto. Such that, the first inner ring 113*a* can be rotated with respect to the first outer ring 113*b* following the rotation of the shaft 124.

Each spindle 130 has a threaded end 132 and a connecting end 134. The threaded end 132 passes the channel 112 of the support 110 and mounted on an end of the channel 112 by a nut 136. The connecting end 134 is designed for connecting the follower 150 therewith.

The driver 140 is designed for driving the follower 150 to rotate. The driver 140 defines a through hole 142 in the center portion thereof. The inner wall of the through hole 142 has formed a meshed structure 144 thereon, such as screw thread, keyways, splines etc, corresponding to the connecting structure 126 of the shaft 124. The driver 140 is attached on the shaft 124 of the handle 120 via the matching between the connecting structure 126 and the meshed structure 144. In addition, in order to reinforce the connection strength between the driver 130 and the shaft 124 of the handle 120, a locker 146 is adopted to match with an end portion of the connecting structure 126, which runs through the driver 140. In the present embodiment, the driver 140 is a gear.

Each follower 150 has a first surface 152 and an opposite second surface 154. A second gearing hole 156 is formed on the first surface 152 of the follower 150 in middle portion thereof and is configured for receiving a second bearing 158 therein. The second bearing 158 has a second inner ring 158*a*, a second outer ring 158*b* and a number of second balls 158*c* contained between the second inner ring 158*a* and the second outer ring 158*b*. The second inner ring 158*a* of the second bearing 158 is fixed on the connecting end 134 of the spindle 130, and the second outer ring 158*b* is fixed to the inner wall of the second gearing hole 156 of the follower 150. Such that, the second outer ring 158*b* can be rotated with respect to the second inner ring 158*a* following the rotation of the follower 150. Engagement between the second outer ring 158*b* of the second bearing 158 and the inner wall of the second bearing hole 156 and the engagement between the second inner ring 158*a* of the second bearing 158 and the connecting end 134 of the spindle 130 are interference fit alleviating any need for additional connecting devices. Understandably, the follower 150 is also a gear in order to mesh with the driver 140. Alternatively, on the second surface 154 of each follower device 150 a connecting device 159 such as a threaded hole and bolt, a buckle, a Latch-locked structure etc, may be used for stably capturing the spanners 160.

The spanners 160 are wrench like structures, each having a hook, a hole, or a pin at an end thereof for meshing with a fastener to provide a mechanical advantage in applying torque to turn fastener such as bolts, nuts or other hard-to-turn items. The spanners 160 are respectively attached on the second surfaces 154 of the followers 150, particularly, the spanners 160 have a connecting structure formed thereon (not shown in the figures) to match with the connecting device 158 of the follower 150.

Understandably, if there are more than two spindles 130 need to be mounted on the support 110, the support 110 should be configured as a rectangular board and at least two crossed channels 112 should be defined on the support 110 for the spindles 130 passing the channels 112 and mounted on the support 110.

In using the hand tool 100, a torque is firstly applied to turn the handle 120. The handle 120 drives the driver 140 mounted on the end of the shaft 124 of the handle 120 to turn. Accordingly, the at least two followers 150 meshed with the driver 140 are driven to turn. As a result, the at least two spanners 160 are turned along with the turning of the followers 150 by which the fasteners such as turn bolts, nuts or other hard-to-turn items are capable of being driven simultaneously and tightened to equal calculated torque.

In addition, because the channel 112 runs through the support 110, the spindles 130 can slide along the channel 112. As a result, it is very convenient to adjust the distance between the two followers 150.

Figure 3:
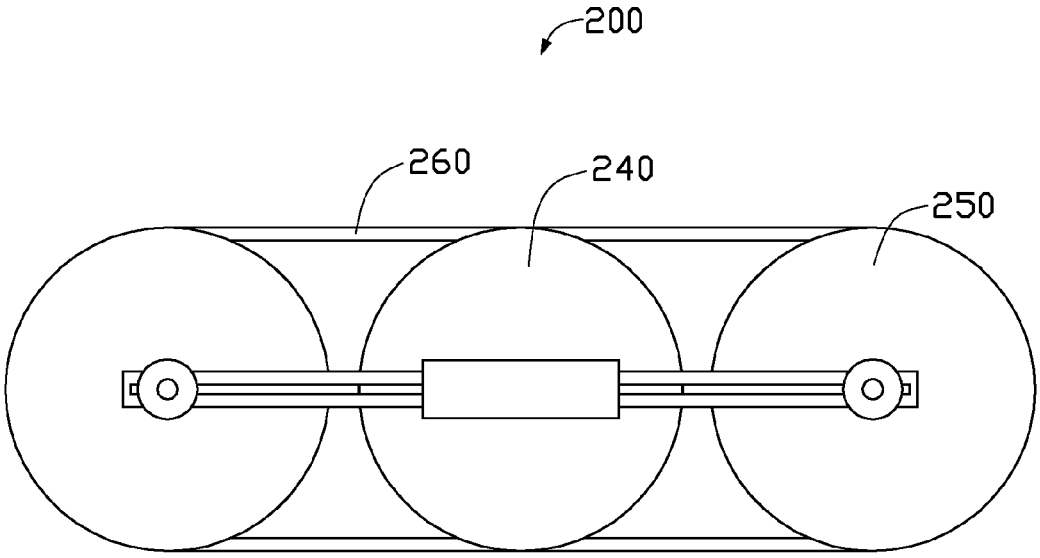
FIG. 3 is a schematic top view of an hand tool according to a second exemplary embodiment.
Figure 4:
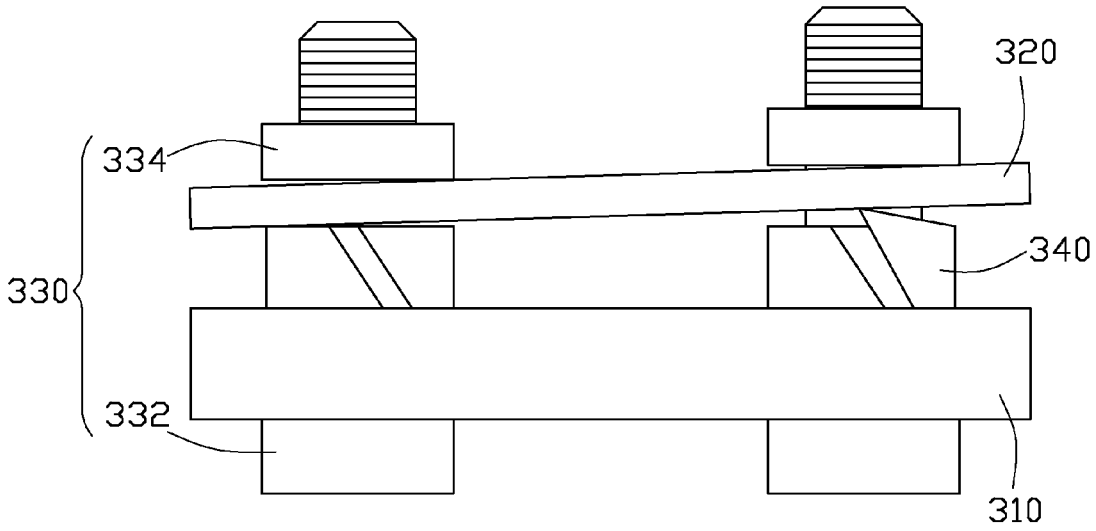
FIG. 4 (RELATED ART)
FIG. 4 is a schematic side view of a bolted joint in related art.

Referring FIG. 3, a hand tool 200 according to a second exemplary embodiment, the difference between the hand tool 200 and hand tool 100 is: A driver 240 of the hand tool 200 is a belt pulley and followers 250 also employ the belt pulley 240, and a strap 260 is adopted to mesh with the pulley 240 and the follower 250 to transfer power of the pulley 240 to the follower 250 for driving the follower 250 to turn.

In addition, the driver 240 may be selected from the group consisting of fluted disc, dentate disc, sprocket and gear plate and so on, and the follower may be one selected from the group consisting of fluted disc, dentate disc and gear plate and so on corresponding to the driver 240.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A hand tool comprising:

a support;

a handle rotatably mounted on a middle portion of the support;

at least two spindles respectively fixed to two opposite ends of the support by ends thereof;

a driver mounted on an end of the handle;

at least two followers respectively rotatably attached on an end of each spindle and drivably connected with the driver;

at least two spanners respectively attached on a surface of each follower which is away from the corresponding spindle;

at least one channel defined on the support, wherein the at least one channel runs through the support from an upper surface to a lower surface thereof, and the at least one channel provides at least one space between the least two followers for at least one distance between the least two followers to be adjusted; and a first nut;

wherein the handle includes a haft and a shaft connected on the middle portion of the haft by one end, the shaft of the handle passes through the at least one channel and is rotatably mounted on the support, the driver is attached on the shaft, each spindle has a threaded end and a connecting end, the threaded end passes through the at least one channel of the support and is mounted on an end of the at least one channel by a second nut, and the at least two followers are respectively mounted on the connecting ends of the spindles;

the first nut is screwed on an end of the shaft having a thread formed thereon for reinforcing the connection strength between the driver and the shaft of the handle; and the end of the shaft defines a connecting structure thereon, the driver defines a through hole in the center portion thereof, the inner wall of the through hole has a meshed structure corresponding to the connecting structure of the shaft, and the driver is attached on the shaft of the handle via the cooperatively matched connecting structure and meshed structure.

* * * * *